US006080244A

United States Patent [19]

Wiatr et al.

[11] Patent Number: 6,080,244

[45] Date of Patent: Jun. 27, 2000

[54] COMPOSITION AND METHODS FOR CLEANING SURFACES

[75] Inventors: Christopher L. Wiatr, McMurray; David Elliott, Imperial, both of Pa.

[73] Assignee: Calgon Corporation, Pittsburgh, Pa.

[21] Appl. No.: 09/157,548

[22] Filed: Sep. 21, 1998

Related U.S. Application Data

[63] Continuation of application No. 08/898,332, Jul. 22, 1997, abandoned.

[51] Int. Cl.[7] ..... B08B 3/04

[52] U.S. Cl. ..... 134/26; 134/27; 134/29; 134/40; 510/188; 510/218; 510/245; 510/254; 510/365; 510/392

[58] Field of Search ..... 134/26, 27, 29, 134/40; 510/188, 218, 245, 254, 365, 392

[56] References Cited

U.S. PATENT DOCUMENTS

| | | | |
|---|---|---|---|
| 4,784,790 | 11/1988 | Disch et al. . | |
| 5,234,832 | 8/1993 | Disch et al. . | |
| 5,256,327 | 10/1993 | Allen et al. . | |
| 5,336,426 | 8/1994 | Rader et al. . | |
| 5,459,066 | 10/1995 | Mestetsky . | |
| 5,462,607 | 10/1995 | Mestetsky et al. . | |
| 5,520,835 | 5/1996 | Sivik et al. . | |
| 5,536,436 | 7/1996 | Pramod | 510/321 |
| 5,538,664 | 7/1996 | Michael . | |
| 5,540,784 | 7/1996 | Ranes . | |
| 5,630,884 | 5/1997 | Huth | 134/27 |
| 5,691,292 | 11/1997 | Marshall et al. . | |
| 5,807,438 | 9/1998 | Lansbergen et al. | 134/25.2 |

FOREIGN PATENT DOCUMENTS

| | | | |
|---|---|---|---|
| 1000628 | 11/1976 | Canada | 195/33.2 |
| 1801119 | 5/1969 | Germany . | |
| 2753679 | 6/1979 | Germany . | |
| 3640799 | 6/1987 | Germany . | |
| 4214884 | 8/1992 | Japan . | |
| 8188893 | 7/1996 | Japan . | |
| 92/15834 | 12/1993 | WIPO . | |
| 94/12607 | 6/1994 | WIPO . | |
| 96/33257 | 10/1996 | WIPO . | |

*Primary Examiner*—Mark Kopec
*Assistant Examiner*—Brian P. Mruk
*Attorney, Agent, or Firm*—Diane R. Meyers; Eckert Seamans Cherin & Mellott, LLC

[57] ABSTRACT

Compositions and methods for cleaning metal and non-metal surfaces utilizing a nonionic surfactant and an enzyme are disclosed. A composition comprised of at least one nonionic surfactant and at least one enzyme and having a pH of between 6 and 9.5 is specifically disclosed. A method for cleaning a surface using this composition, and a method for cleaning a surface using a first composition comprising at least one nonionic surfactant and a second composition comprising at least one enzyme are also disclosed.

6 Claims, 2 Drawing Sheets

(2 of 2 Drawing Sheet(s) Filed in Color)

COMPOSITION AND METHODS FOR CLEANING SURFACES

This application is a continuation of U.S. Ser. No. 08/898,332 filed on Jul. 22, 1997 and abandoned on Jan. 14, 1999.

BACKGROUND OF THE INVENTION

1. Field of the Invention

The present invention relates to compositions comprising one or more enzymes and one or more surfactants, useful in the cleaning of industrial and non-industrial equipment. The present invention further relates to novel cleaning methods using surfactants and enzymes to remove oil, grease and other hydrophobic and/or industrial wastes from various surfaces. One method involves cleaning the surface by contacting it with a composition comprising one or more enzymes and one or more surfactants. A second method involves sequentially contacting of the surface first with a surfactant-containing solution and then with an enzyme-containing solution.

2. Background Information

The equipment used in numerous industries comes into contact with various contaminants, which can impede the operation of the equipment and otherwise interfere with production. This effects nearly every industry, including, for example, the chemical processing industry, the oil refinery industry, the pulp and paper industry, the general manufacturing industry, and the food and beverage industry. Numerous ferrous and non-ferrous metal surfaces, as well as plastic surfaces, can similarly become contaminated with oils, greases and other hydrophobic contaminants, as well as inorganic contaminants such as soil. These contaminants are often difficult and expensive to remove using conventional cleaning products and methods. A cleaning step is also routinely included in metal and plastic surface finishing. Typically, these surfaces are cleaned before phosphatizing, rust proofing, painting and the like is done to the surface.

Many aqueous industrial and household cleaners contain a mixture of enzymes and surfactants. The enzymes primarily serve to attack or degrade organics, while the surfactant acts to disperse the degraded particles in the aqueous phase.

Numerous cleaning compositions have alkaline components, such as a caustic, an alkali or an alkaline metal cation. For example, an alkaline based cleaning composition is disclosed in U.S. Pat. No. 5,256,327. More specifically, the cleaning composition is a substantially dry, water soluble dishwashing composition comprising intimately admixed particles of a carbonate salt and a citrate where the salts have a common alkaline metal cation, an anti-redeposition agent, an alkaline metal silicate, a nonionic surfactant, and an enzyme system. Alkaline cleaners, although effective, are considered environmentally unfriendly with harsh or hazardous effects and are therefore not preferred.

U.S. Pat. No. 4,784,790 relates to preparations and processes for cleaning and disinfecting endoscopes. The method includes successively contacting the endoscopes with a heated cleaning solution, contacting the endoscopes with a heated disinfectant solution, washing the endoscopes with heated water and drying the endoscopes with sterilized hot air. The cleaning solution contains at least one low-foam nonionic surfactant, at least one proteolytic enzyme, at least one complexing agent and, optionally, other standard detergent ingredients, and has a pH value of 6 to 8.

U.S. Pat. No. 5,234,832 discloses a method for cleaning and disinfecting medical instruments similar to that in U.S. Pat. No. 4,784,790 but utilizing a cleaning solution having a pH of from 6 to 8 and containing a low-foam nonionic surfactant, a proteolytic enzyme, a complexing agent, and an aldehyde selected from the group consisting of formaldehyde and aliphatic dialdehydes containing 2 to 8 carbon atoms and, optionally, other standard detergent and disinfectant constituents. This method further differs from the '790 patent in that it does not include the disinfecting step.

U.S. Pat. No. 5,462,607 relates to a method of removing hydrocarbons and coke deposits from industrial processing equipment. The method involves use of an aqueous cleaning solution containing from 30 to 2500 ppm of an amine oxide surfactant and 1 to 200 ppm of an enzyme. The method further involves introducing the cleaning solution into a vessel having hydrocarbons and coke deposits on its walls, partially filling the vessel, heating the solution in the vessel to an elevated temperature sufficient to ebullate the solution and generate foam, circulating the heated solution through the vessel and flowing the foam from the vessel.

U.S. Pat. No. 5,540,784 similarly relates to a method for cleaning equipment containing solids and oil contaminants on an interior surface by creating a closed-flow system within the equipment, introducing an aqueous cleaning solution containing enzymes and an amide oxide surfactant to a pressure vessel in the system to partially fill the vessel, heating the cleaning solution to a temperature above the boiling point of water, circulating the cleaning solution through the system, thereby bringing the cleaning solution into contact with the oil and solid contaminants and removing the contaminants. A pressure is maintained within the closed flow system at a value above atmospheric pressure. The cleaning solution contains 30 to 2100 ppm of a surfactant and 1 to 200 ppm of an enzyme.

U.S. Pat. No. 5,459,066 relates to a method of separating oleophilic-hydrophobic material from wash water. The methods employ a solution comprising 30–2100 ppm of an amide oxide surfactant and 1–200 ppm of an enzyme. The solution is mixed with wash water and oil and allowed to stand in a quiescent state for a time sufficient for the formation of an oil phase and an aqueous phase. The oil phase is then separated from the aqueous phase.

U.S. Pat. No. 5,538,664 discloses a hard surface detergent composition comprising a nonionic detergent surfactant, a hydrophobic cleaning solvent, and optionally containing one or more of polycarboxylate detergent builders, zwitterionic detergent surfactants, alkanolamine pH buffer, enzymes, hydrotropes, polar solvents, colorants, perfumes and a suds control system comprising fatty acid and anionic sulfonated and/or sulfate detergent surfactant.

German Abstract DE 1801119 discloses a detergent and soap powder containing a bleaching agent and an enzyme prepared by coating or encapsulating the bleaching agent with a water insoluble material dispersible in water at a temperature between 60 and 70°. A proteolytic enzyme is coated with a water soluble material such as sugar, a nonionic surfactant, CM-cellulose gum, or polyvinyl alcohol.

Patent Application WO 9412607 relates to a hard surface cleaning composition comprising a solvent, surfactant and a lipolytic enzyme. The solvent contains at least one alcoholic hydroxyl group and one ether linkage and is essential for the performance of the cleaning composition. The surfactant is compatible with the lipase.

German Abstract DE 3640799 discloses a washing composition containing at least one amino or hydroxy alkane sulphonate derivative and at least one enzyme. There is no indication that the abstract teaches the compositions or methods of the present invention.

International Application WO 9633257 discloses a stabilized enzyme-based cleaning solution containing an enzyme, including a lipase or protease, a surfactant and glycerol and/or ethylene glycol as an enzyme stabilizer.

Japanese Abstract JP 4214884 discloses a cleaner for noble metals and ornaments containing carbonate, organic acid, reducing agent, surfactant and protease.

Japanese Abstract JP 8188893 discloses a cleaning agent containing a fat-decomposing enzyme and a non-ionic surfactant at a ratio of 100:1–1:100 and a pH of 6.5–10.

German Abstract DE 2753679 discloses a stable aqueous washing and cleaning composition containing catalase, an anionic surfactant and a nonionic polygonal ether derivative surfactant.

None of the above references teach a cleaning composition comprising at least one nonionic surfactant and at least one enzyme as taught by the present invention. Nor do any of these references teach a method for cleaning metal or plastic surfaces comprising contacting the surface to be cleaned with this composition, or by contacting the surface to be cleaned with a first solution containing a nonionic surfactant, and then contacting the surface with a second solution containing an enzyme. There remains a need, therefore, for cleaning compositions and methods that are efficient, cost effective, biodegradable and otherwise friendly to the environment.

SUMMARY OF THE INVENTION

The present invention has met the above described need by-providing a composition for use in cleaning metal and non-metal surfaces comprising at least one nonionic surfactant and at least one enzyme.

The present invention has also met the above described need by providing methods for cleaning a surface so as to remove oils, grease, other hydrophobic matter, inorganic soils and other industrial and non-industrial waste from the surface. These methods generally comprise contacting the surface with a surfactant and an enzyme. In one embodiment, the surfactant and enzyme are contained with the same solution. Another embodiment comprises contacting the surface with a first solution containing at least one nonionic surfactant, and then contacting the surface with a second solution containing at least one enzyme.

Most cleaning applications require removal of both inorganic soils and organic greases, oils, or other hydrophobic matter. According to the present invention, lipase enzymes can be used in conjunction with a nonionic surfactant based cleaning solution to remove fatty greases and soils from metal and non-metal parts. The surfactant disperses the soil and loosens hydrophobic matter, and the enzyme hydrolyzes fatty ester linkages, resulting in more effective cleaning.

It is therefore an object of the invention to provide a cleaning composition comprising at least one nonionic surfactant and at least one enzyme.

It is a further object of the invention to provide such a cleaning solution that is biodegradable, cost effective, and environmentally friendly.

Yet another object of the invention is to provide a method of cleaning a metal or non-metal surface using an enzyme and a nonionic surfactant.

A further object of the invention is to provide a method for cleaning metal and non-metal surfaces contaminated by industrial waste.

A further object of the invention is to provide a method for cleaning metal and non-metal surfaces comprising contacting the surfaces with a composition comprising at least one nonionic surfactant and at least one enzyme.

A further object of the invention is to provide a method for cleaning contaminated metal and non-metal surfaces by contacting the surfaces with a first solution containing at least one nonionic surfactant and a second solution containing at least one enzyme.

These and other objects of the invention will be readily apparent to one skilled in the art upon reading the detailed description of the invention.

BRIEF DESCRIPTION OF THE DRAWINGS

The file of this patent contains at least one photograph in color. Copies of this patent with color photographs will be provided by the Patent and Trademark Office upon request and payment of the necessary fee.

DETAILED DESCRIPTION OF THE INVENTION

Figure 1A:
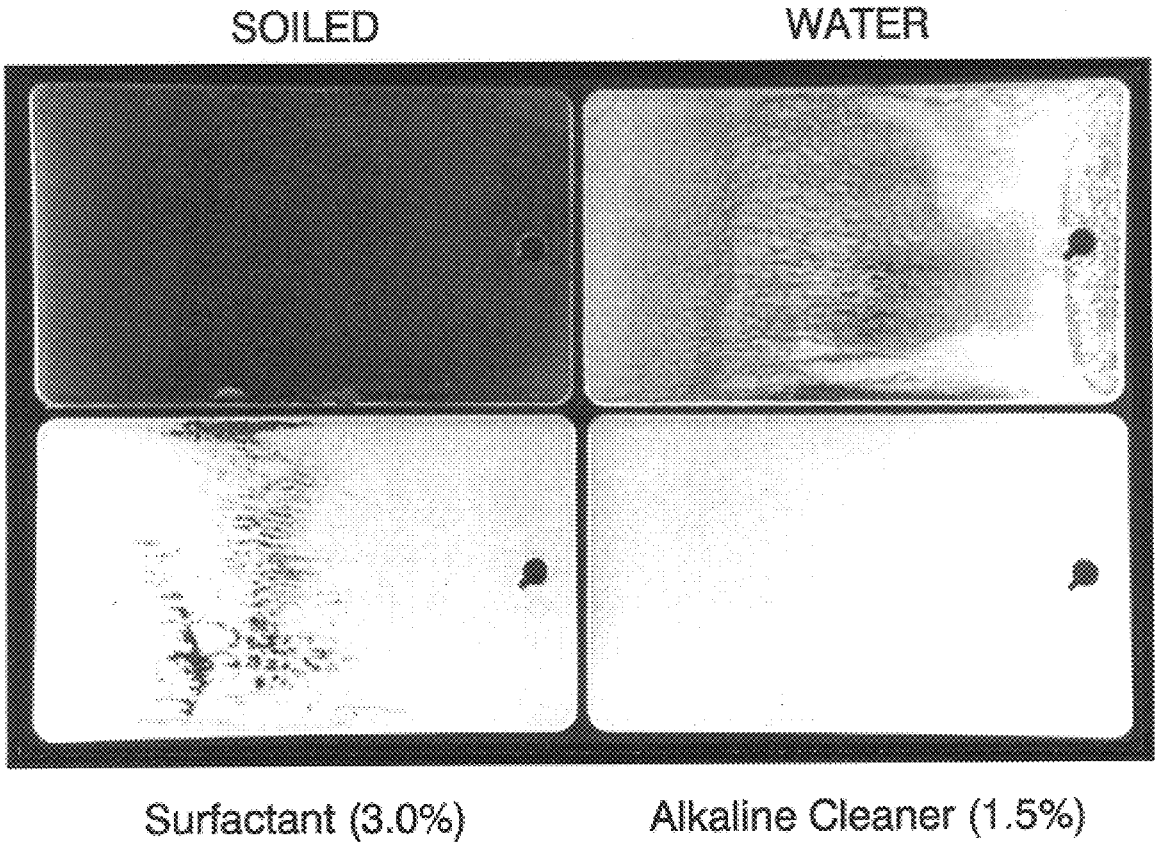
FIGS. 1*a* and 1*b* each provide photographs of four panels tested according to the method of Example 2.

The present invention is directed to a cleaning composition comprising at least one nonionic surfactant and at least one enzyme, and having a pH within the range of about 6 to 9.5. The combination of the non-ionic surfactant and the enzyme has been found to be synergistic, and provides enhanced cleaning when using a surfactant or enzyme alone.

Numerous nonionic surfactants are within the scope of the present invention. Such surfactants include, but are not limited to, alkyl aryl polyether alcohols having degrees of ethoxylation from 1.5 to 120, including but not limited to, alkyl phenol ethoxylates having an alkyl chain length of between about 6 and 18 carbons, such as nonylphenol ethoxylates, octylphenol ethoxylates and dodecylphenol ethoxylates; alkyl polyether alcohols having degrees of ethoxylation from 1.5 to 120, including but not limited to, linear polyether alcohols having an alkyl chain length from between about 4 and 22 carbons, mixed linear alcohol ethoxylates, secondary alcohol ethoxylates having an alkyl chain length from between about 6 and 22 carbons, branched alkyl alcohol ethoxylates having between about 8 and 22 carbons, such as tridecylalcohol ethoxylates, trimethylnonanyl ethoxylates, and isodecyl alcohol ethoxylates, isotridecyl alcohol ethoxylates; nonionic amides such as alkanolamides, including but not limited to, 1:1 diethanolamides, monoethanol amides, monoisopropanolamides, 2:1 alkanolamides and modifications thereof, ethoxylated alkanolamides, and bisamides; nonionic esters, including but not limited to, alcohol, glycerol, and glycol esters, polyethylene glycol (PEG) esters such as diethylene glycol monostearates, glycerol monostearate, PEG laurates, PEG dilaurates, PEG monooleates, and PEG dioleates, where PEG has a molecular weight ranging between about 100 and 1000; ethoxylated acids and oils, including derivatives of castor oil, oleic acid, linoleic acid, myristic acid, lauric acid, and stearic acid, among others, where the organic acids have from between about 6 to 20 carbons having linear and branched chain structures, and degrees of ethoxylation from 1.5 to 200; sorbitan esters and ethoxylated sorbitol esters, including but not limited to sorbitan monolaurate, ethoxylated sorbitan inonolaurate, sorbitan monooleate, ethoxylated sorbitan monooleate, sorbitan trioleate and ethoxylated sorbitan trioleate, where the polyhydric alcohols and sugars have a degree of ester substitution of between about 1 and 4, and degrees of ethoxylation from between about 0 to 200; alkyl polyglucoside surfactants having between about 1 and 10 saccharide units and alkyl substitution from between about 0.5 and 2.5; ethoxylated mercaptans having an alkyl chain length from between about 6 and 18 carbons and a degree of ethoxylation from between about 4 and 20; low foaming surfactants, including ethylene oxide/propylene oxide (EO/PO) block copolymers such as the Pluronic® and Tetronic® products available from BASF Corporation, Parsippany, N.J., linear alcohol EO/PO, branched alcohol EO/PO, aryl alkaryl EO/PO, and linear alcohol EO with a chlorine cap; ethylene oxide/propylene oxide copolymers, including both block and random copolyiners, having a molecular weight from between about 1000 and 25,000 and cloud point from 10 C to greater than 100 C; and amine ethoxylates having a degree of ethoxylation from 1.5 to 75 and alkyl groups having from between about 4 to 22 carbons. The composition of the present invention does not encompass use of amine oxides as the nonionic surfactants.

Any combination of the above nonionic surfactants can also be used, provided no problems arise with the compatibility of the surfactants. Compatibalizing agents, such as hydrotropes, can be used with these surfactants as required.

Preferred nonionic surfactants for use in the compositions and methods of the present invention are hard surface cleaning and low foaming surfactants, such as the alkyl aryl polyether alcohols, alkyl polyether alcohols, ethoxylated mercaptans and low foaming sufactants described above.

In addition, one or more of the above nonionic surfactants can be mixed with one or more anionic surfactants. Suitable anionic surfactants include, but are not limited to, alkyl sulfates, alkyl ether sulfates, alkyl sulfonates, alkylaryl sulfonates, sulfosuccinates, phosphate esters, carboxylates, saponified organic soaps, alkyl isethionates, amine ethoxy sulfates and alkyl phenolethoxy sulfates.

When using both nonionic and anionic surfactants, any ratio of nonionic to anionic surfactant within the range of 10:1 to 1:2 can be used, with a ratio of between 4:1 and 1:1 being preferred. When using a mixture of nonionic and anionic surfactants, an excess of nonionic surfactant is preferred, and if using excess anionic surfactant, an anionic to nonionic surfactant ratio of 2:1 should not be exceeded. This is to prevent destabilization of the enzyme, such as that caused by anionic surfactants. Formulations containing only nonionic surfactants are most preferable over nonionic/anionic surfactant combinations.

The composition should contain at least 1.0% of total surfactant, including both nonionic surfactant and anionic surfactant, if used. More preferably, the amount of total surfactant will be in the range of 1.5 and 6%, although amounts up to 25% or higher can be used.

Also present in the cleaning composition of the present invention is at least one enzyme. Preferably, the enzyme is a lipase. Most preferably, this lipase is a broad spectrum lipase that breaks down fat, grease, oil and other hydrophobic material. This enzyme, in conjunction with the surfactant of the present invention, also serves to remove non-organic contaminants from metal and plastic surfaces. A suitable lipase for use in the present invention is Lipolase®, commercially available from Novo Nordisk, Franklin, N.C. Lipolase® contains a broad spectrum lipase, and also contains trace amounts of catalase. Catalase is an oxidizing enzyme that decomposes hydrogen peroxide. The catalase therefore helps to capture free radicals and does not play a significant role in the present invention.

The enzyme should be present in the solution in a concentration of at least 0.01%. More preferably, this concentration will range between about 1 and 10%, more preferably between about 1.0 and 3.0%. For example, a volume to volume dilution of Lipolase® to water can be performed so as to bring the active enzyme concentration within this range. Lipolase® 100 L has 100,000 active enzyme units; a solution containing 1 to 10% of this formulation would therefore contain about 10 and 10,000 active enzyme units.

The ratio of surfactant to enzyme in the composition should be greater than 1:1 of surfactant:enzyme. The amount of total surfactant in the composition, both nonionic and anionic if used, should be greater than that of the enzyme.

It will be understood that the cleaning composition of the present invention can also contain other components such as solvents, water, stabilizers, hydrotropes, builders and suitable preservatives. Other additives include defoamers, corrosion inhibitors, dyes, perfumes and chelants. Any such products known to those skilled in the art can be used, provided they do not lead to compatibility problems with the surfactant and/or enzyme, and provided they do not interfere with the cleaning action of the surfactant and enzyme. Examples of these ingredients include, but are not limited to, phosphates, silicates, hydrotropes such as sodium xylene sulfonate or a phosphate ester surfactant, carbonates, borates and the like.

The cleaning composition of the present invention should have a pH within the range of 6 to 9.5. Accordingly, an acid or base can be used as necessary to bring the pH of the composition within this desired range.

The present invention is also directed to a method for cleaning surfaces comprising contacting the surface with a composition comprising at least one nonionic surfactant and at least one enzyme. The composition as described above can be used in this method.

Various surfaces can be cleaned according to this method, including both metallic and non-metallic surfaces. Metallic surfaces include ferrous and non-ferrous surfaces. Ferrous surfaces include, but are not limited to, steel, cold-rolled steel, cast iron, tin-plated steels, copper-plated steels, organic-coated steels, galvanized steels and zinc/aluminum galvanized steels. Non-ferrous surfaces include, but are not limited to, aluminum and aluminum alloys, zinc and zinc-based alloys, zinc-aluminum alloys, and copper and copper alloys.

Non-metallic surfaces include plastics, including but not limited to, polycarbonates, polyvinyl chlorides, polyethylenes, polypropylenes, thermoplastic polyesters or polyamides, polyurethanes, epoxides or polyepoxies, polystyrene or its copolymers, nylons and modified polyamides, and modified celluloses.

Contacting the surface with the composition can be achieved by any means known in the art. Typical contacting methods include immersion or dipping the equipment or surface to be cleaned in a bath of the composition. All forms of immersion cleaning, such as typical immersion cleaning, ultrasonic cleaning and the like are contemplated by this invention. Alternatively, the composition can be sprayed onto the surface by any spray means known in the art, such as through use of cabinet washing or a conveyor system used with a spray chamber. The contact time between the surface to be cleaned and the composition should be at least 30 seconds, with 1–10 minutes being preferred. Longer contact times are also within the scope of the present invention. Following the contact period, the composition can either be removed from the surface, or the surface can be further treated, such as with a phosphatizer, or rust proofing agent. Removal of the composition from the surface can be effected by any means known in the art, such as through rinsing.

As will be appreciated by those skilled in the art, the contact time for the solution will vary depending upon various factors, such as the surface to be cleaned, the amount of contamination on the surface, the type of contamination of the surface and the type of configuration of the washing equipment. Adjustment of contact time to maximize the effects of the methods of the present invention are within the scope of one skilled in the art.

The present invention is further directed to a method for cleaning a surface comprising contacting the surface first with a solution containing at least one nonionic surfactant and second with a solution containing at least one enzyme.

The first solution can contain at least one of the nonionic surfactants described above. In addition, amine oxide nonionic surfactants could be used in this method. Again, more than one nonionic surfactant can be used in the solution. In addition, an anionic surfactant as listed above can be combined with the nonionic surfactant. If both nonionic and anionic surfactants are used, the ratio of nonionic to anionic surfactant should be within the range of 10:1 to 1:2. The preferred ratio of nonionic to anionic surfactant is between about 4:1 and 1:1. Such a solution can be prepared generally as described above, but without the addition of the enzyme and enzyme stabilizers. That is, a solution can be formed containing between about 1.0 and 25% of total surfactant (both nonionic and anionic, if used) and various additives such as solvents, builders, stablizers, hydrotropes, defoamers, corrosion inhibitors and the like. Commercially available surfactant compositions within this description can also be used.

The second solution contains at least one enzyme. Preferably, this enzyme is lipase, more preferably a broad spectrum lipase that breaks down fat, grease, oils and other hydrophobic material. Again, such an enzyme is available from Novo Nordisk as Lipolase®. Lipolase® contains both lipase and catalase.

The enzyme solution can be prepared according to any method known in the art, and should have an active enzyme unit concentration of at least 0.01%, preferably between about 1 and 10%, more preferably between about 1 and 3%. The enzyme solution can further contain enzyme stabilizers, defoamers and the like. An enzyme solution can be prepared, for example, using Lipolase®. Lipolase® 100 L contains 100,000 active enzyme units. A volume to volume dilution of Lipolase® to water can be performed so as to yield a solution with the desired active enzyme concentration.

Both metal and non-metal surfaces can be cleaned according to this method. Metallic surfaces include both ferrous and non-ferrous surfaces as described above, and non-metallic surfaces including the plastic surfaces as described above.

According to this embodiment of the invention, the surface to be cleaned is contacted first with the surfactant-containing solution. This solution should remain in contact with the surface for at least 30 seconds, more preferably 1–10 minutes. The surface should then be contacted with the second solution, which is an enzyme containing solution. This solution should be in contact with the surface for at least 30 seconds, preferably 1–10 minutes. Again, longer contact times for each of the solutions can also be employed. The two solutions can then be removed from the surface by means known in the art, such as through rinsing.

The contact time for each of the solutions will vary depending upon various factors, such as the surface to be cleaned, the amount of contamination on the surface, and the type of contamination of the surface and the type or configuration of the washing equipment. Adjustment of contact time to maximize the effects of the methods of the present invention are within the scope of one skilled in the art.

According to the methods of the present invention, it is believed that the surfactant helps the enzyme to contact the contaminant, thereby allowing the enzyme to attack and disperse the contaminant better. The inventors do not wish to be bound by this mechanism, however.

The compositions and methods of the present invention typically yield results comparable with those achieved by alkaline cleaners. The present compositions and methods offer an advantage over these alkaline cleaners in that they are biodegradable and otherwise friendly to the environment, while the alkaline based cleaners are not. In addition, water containing the enzyme can be collected and re-used in the methods taught herein. The compositions and methods of the present invention therefore provide a very cost effective means for cleaning a variety of contaminants from a variety of surfaces.

EXAMPLES

The following examples are intended to illustrate the invention, and should not be construed as limiting the invention in any way.

Example 1

A soil spec formulation was prepared mixing the ingredients listed in Table 1.

TABLE 1

| Item # | Material | % |
|---|---|---|
| 1 | Stearic acid | 2.0 |
| 2 | Crisco ® | 2.5 |
| 3 | Mineral spirits | 40.0 |
| 4 | Soybean oil | 2.0 |
| 5 | Oleic acid | 4.0 |
| 6 | Paraffin wax | 3.0 |
| 7 | Metallic red oxide | 1.5 |
| 8 | 80/20 clay sebum | 10.0 |
| 9 | Cholesterol | 2.0 |
| 10 | Ethanol | 32.25 |
| 11 | Carbon black | 0.75 |

The sebum composition was prepared using the formulation shown in Table 2.

TABLE 2

| Item # | Material | % |
|---|---|---|
| 1 | Linoleic acid | 5.0 |
| 2 | Squalene | 5.0 |
| 3 | Oleic acid | 10.0 |
| 4 | Coconut oil | 15.0 |
| 5 | Olive oil | 20.0 |
| 6 | Cholesterol | 5.0 |
| 7 | Stearic acid | 5.0 |
| 8 | Palmitic acid | 10.0 |
| 9 | Paraffin wax | 10.0 |
| 10 | Spermaceti wax | 15.0 |

Example 2

Q panels, obtained from the Q-panel Company, were used for the following examples. The Q panels were type R, SAE 1010 cold-rolled steel, 0.032 inches thick with a dull matte finish. The soil spec formulation described in Example 1 was applied to the Q panels using a draw down method (draw down bar #10 size). The panels were washed using a spray washer at 130° F. with a spray pressure of about 15 psi. The panels were washed as indicated in Table 3 and air dried for 24 hours.

TABLE 3

| Sample | Description | Concentration | Time |
|---|---|---|---|
| 1 | Alkaline cleaner* (Stage 1) | 1.5% by volume | 1 minute |
| | Tap water (Stage 2) | N/A | 30 sec. |
| 2 | Tap water | N/A | 1 minute |
| 3 | Surfactant solution** (Stage 1) | 3% by volume | 1 minute |
| | Tap water (Stage 2) | N/A | 30 sec. |
| 4 | Surfactant solution** (Stage 1) | 3% by volume | 1 minute |
| | Lipolase 100L*** (Stage 2) | 5% by volume | 1 minute |
| | Tap water (Stage 3) | N/A | 30 sec. |

*The alkaline cleaner contains zeolite-softened water (69.5%), caustic soda (25%), sodium gluconate (5%), and an acrylic acid/sulfonated monomer copolymer (0.5%).
**The surfactant solution contains zeolite-softened water (79.84%), nonyl phenol ethoxylate surfactant with 9 EO units (10%), an ethylene oxide/propylene oxide block copolymer (10%) (Pluronic ® 25R2 commercially obtained from BASF), adamantane chloride (Dowicil ® 75 preservative commercially obtained from Dow Chemical), and a dye (0.01%).
***A commercial lipase having about 100,000 enzyme units, obtained from Novo Nordisk.

Figure 1B:
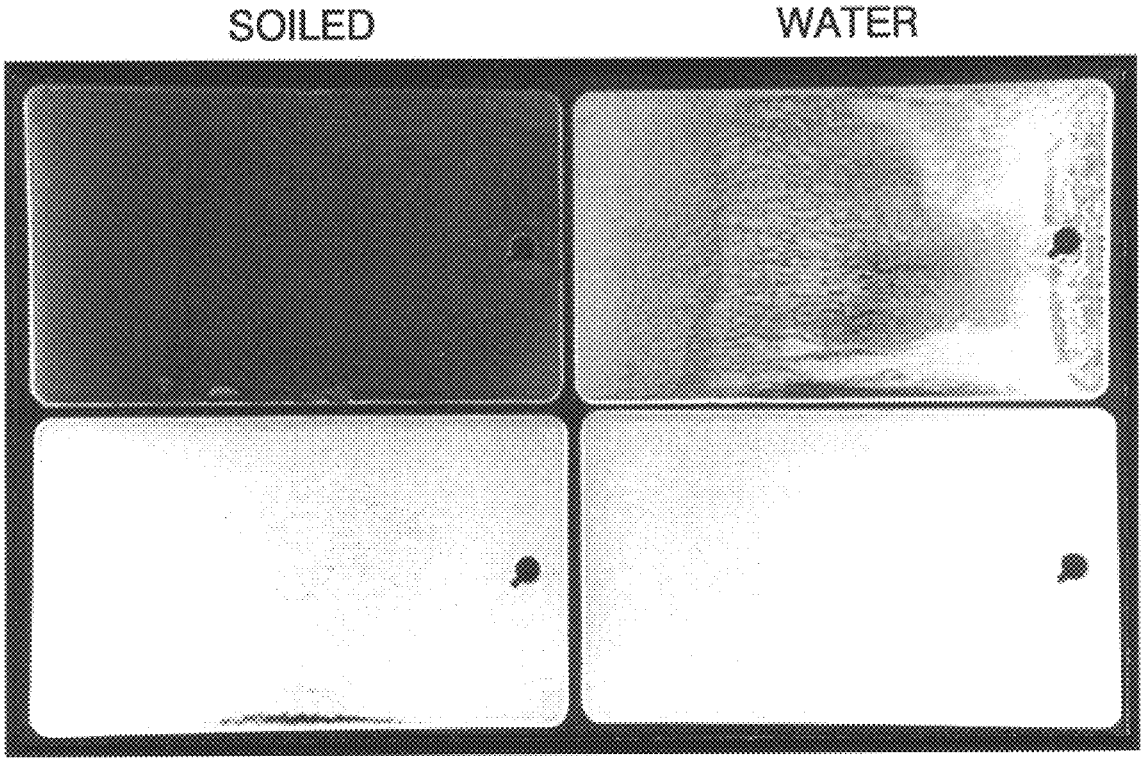

As can be seen in the photographs of FIG. 1, superior cleaning performance was achieved when using the surfactant solution/enzyme combination than when using the surfactant solution alone. The performance of the surfactant solution/enzyme combination was comparable to that of the alkaline cleaner.

Example 3

Cold-rolled steel parts from Allegheny Ludlum Corp. were used for this example. The soil was a typical mill soil consisting of a rolling oil and particulates.

Using a spray washer, the following tests were run at 130° F. with a spray pressure of about 25 psi:

TABLE 4

| Sample | Description | Concentration | Contact Time |
|---|---|---|---|
| 1 | Tap water | N/A | 1 minute |
| 2 | Alkaline cleaner* (Stage 1) | 1.5% by volume | 1 minute |
| | Tap water (Stage 2) | N/A | 30 sec. |
| 3 | Surfactant solution* (Stage 1) | 3% by volume | 1 minute |
| | Tap water (Stage 2) | N/A | 30 sec. |
| 4 | Lipolase ® 100L (Stage 1) | 3% by volume | 1 minute |
| | Tap water (Stage 2) | N/A | 30 sec. |
| 5 | Lipolase ® 100L (Stage 1) | 5% by volume | 1 minute |
| | Tap water (Stage 2) | N/A | 30 sec. |
| 6 | Surfactant solution (Stage 1) | 3% by volume | 1 minute |
| | Lipolase ® 100L (Stage 2) | 3% by volume | 1 minute |
| | Tap water (Stage 3) | N/A | 30 sec. |
| 7 | Surfactant solution (Stage 1) | 3% by volume | 1 minute |
| | Lipolase ® 100L (Stage 2) | 5% by volume | 1 minute |
| | Tap water (Stage 3) | N/A | 30 sec. |

*The alkaline cleaner, surfactant solution and Lipolase ® were as described in Example 2.

The parts were dried using ambient forced air after cleaning. Two aspects of the panel surface were measured, degree of soil removal, and tenacity of the remaining soil on the surface. Degree of soil removal was graded by visual inspection of the metal parts using the following scale:

| | |
|---|---|
| 5 | complete removal of soil from metal surface |
| 4 | 80% of soil removed from metal surface |
| 3 | 50% of soil removed from metal surface |
| 2 | 20% of soil removed from metal surface |
| 1 | no soil removal from metal surface |

Tenacity of the remaining soil was measured using a wipe test. The test consisted of wiping the surface of the metal parts using hand pressure (two fingers) with a two-ply, 1×5 inch piece of a standard paper towel (Utility-Wipes Disposable Wipers commercially obtained from Kimberly-Clark). Tenacity was graded using the following scale:

| | |
|---|---|
| 5 | significant discoloration of paper, denoting low soil tenacity to metal surface |
| 4 | moderate discoloration of paper |
| 3 | some discoloration of paper |
| 2 | minor discoloration of paper |
| 1 | no discoloration of paper, denoting high soil tenacity to metal surface |

The results of the testing are shown in Table 5.

TABLE 5

| Sample | Rating (Degree of soil removal) | Rating (Tenacity of soil) | Comments |
|---|---|---|---|
| 1 | 2 | 2 | Low soil removal, much remaining soil, remaining soil is difficult to remove. |
| 2 | 4.5 | 4 | Good soil removal, little remaining soil, relatively easy to remove. |
| 3 | 3 | 4 | Some soil removal, significant remaining soil, relatively easy to remove. |
| 4 | 2 | 4 | Low soil removal, much remaining soil, easier to remove than tap water alone. |
| 5 | 2 | 4 | Low soil removal, much remaining soil, easier to remove than tap water alone. |
| 6 | 3 | 3 | Average soil removal, some remaining soil, relatively easy to remove. |
| 7 | 4 | 3 | Good soil removal, little remaining soil, relatively easy to remove. |

Thus, the combination of surfactant solution and enzyme roughly matched the alkaline cleaner in overall cleaning performance.

Example 4

Tests were run as generally described in Example 3. Panel treatments were as shown in Table 6 using a panel spray washer at about 25 psi.

TABLE 6

| Process | Stage | Product(s) | Product Concentration (%) | Temp. (° F.) | Time (Min/Sec) |
|---|---|---|---|---|---|
| 1 | 1 | Surfactant solution* | 3.0 | 130 | 1.0 min. |

TABLE 6-continued

| Process | Stage | Product(s) | Product Concentration (%) | Temp. (° F.) | Time (Min/Sec) |
|---|---|---|---|---|---|
| | 2 | Surfactant solution* | 3.0 | 130 | 1.0 min. |
| | 3 | Tap water rinse | — | Room temp. | 30 sec. |
| 2 | 1 | Surfactant solution* | 3.0 | 130 | 1.0 min. |
| | 2 | Lipolase ®* | 3.0 | 130 | 1.0 min. |
| | 3 | Tap water rinse | — | Room temp. | 30 sec. |
| 3 | 1 | Surfactant solution* | 3.0 | 130 | 1.0 min. |
| | 2 | Lipolase ®* | 5.0 | 130 | 1.0 min. |
| | 3 | Tap water rinse | — | Room temp. | 30 sec. |

*The surfactant solution and Lipolase ® solution were as described in Example 2.

The results are shown in Table 7, and use the grading system used in Example 3.

TABLE 7

| Sample | Rating (Degree of soil removal) | Rating (Tenacity of soil | Comments |
|---|---|---|---|
| 1 | 3 | 2.5 | Moderate soil removal, moderate remaining soil, somewhat difficult to remove. |
| 2 | 3.5 | 3.5 | Greater soil removal than Sample 1, somewhat easier to remove remaining soil. |
| 3 | 4 | 3 | Greater soil removal than Samples 1 and 2, soil easier to remove than Sample 1. |

Tests where two surfactant solution stages were used were not as effective in cleaning performance as the surfactant solution/enzyme two-stage combinations.

Example 5

A formulation was prepared consisting of 26% zeolite-softened water, 1% boric acid, 0.5% Hartopol® 25R2 (ethylene oxide/propylene oxide copolymer commercially obtained from Huntsman), 3% Igepal® CA-620 (octyl phenol ethoxylate commercially obtained from Rhone Poulenc), 64.5% propylene glycol, and 5% Lipolase® 100 L commercially obtained from Novo Nordisk (Solution 1). A similar formulation containing no enzyme (replaced with zeolite-softened water) was also prepared (Solution 2).

Cleaning tests were conducted as shown in Table 8 using a spray washer operating at about 25 psi.

TABLE 8

| Product | Testing Parameters | | | | Sample # |
|---|---|---|---|---|---|
| | Stage | % Usage | Temp. (° F.) | Time | |
| Water | 1 | — | 130 | 1.0 min. | 1 |
| | 2 | Water rinse | Room temp. | 30 sec. | |
| Solution 1 | 1 | 3.0 | 130 | 1.0 min. | 2 |
| | 2 | Water rinse | Room temp. | 30 sec. | |
| Solution 2 | 1 | 3.0 | 130 | 1.0 min. | 3 |
| | 2 | Water rinse | Room temp. | 30 sec. | |
| Solution 2 | 1 | 10.0 | 130 | 1.0 min. | 4 |
| | 2 | Water rinse | Room temp. | 30 sec. | |

TABLE 8-continued

| Product | Testing Parameters | | | | Sample # |
|---|---|---|---|---|---|
| | Stage | % Usage | Temp. (° F.) | Time | |
| Solution 1 | 1 | 10.0 | 130 | 1.0 min. | 5 |
| | 2 | Water rinse | Room temp. | 30 sec. | |
| Alkaline cleaner* | 1 | 3.0 | 130 | 1.0 min. | 6 |
| | 2 | Water rinse | Room temp. | 30 sec. | |

*Alkaline cleaner was as described in Example 2.

Results are summarized in Table 9.

TABLE 9

| Sample | Rating (Degree of soil removal) | Rating (Tenacity of soil) | Comments |
|---|---|---|---|
| 1 | 2 | 2 | Low soil removal, substantial soil remaining on panel, remaining soil difficult to remove. |
| 2 | 3 | 4 | Moderate soil removal, moderate soil remaining on panel, remaining soil easy to remove. |
| 3 | 3 | 3 | Moderate soil removal, moderate soil remaining on panel, remaining soil not as easy to remove as in Sample 2. |
| 4 | 3 | 3 | Same as in Sample 3. |
| 5 | 4 | 3 | Good soil removal, little soil remaining on panel, remaining soil easy to remove. |
| 6 | 4 | 4 | Good soil removal, little soil remaining on panel, remaining soil easy to remove. |

The enzyme-containing formulation (Solution 1) shows superior cleaning performance over the formulation with no enzyme (Solution 2). Its performance approaches that of the alkaline cleaner.

Whereas particular embodiments of this invention have been described above for purposes of illustration, it will be evident to those skilled in the art that numerous variations of the details of the present invention may be made without departing from the invention as defined in the appended claims.

What is claimed is:

1. A method for removing hydrophobic contaminants from a metal surface consisting essentially of:

sequentially contacting said surface with a first solution consisting essentially of about 1 to 25 weight percent of at least one low-foaming nonionic surfactant and, optionally, one or more additives selected from the group consisting of solvents, builders, stabilizers, hydrotropes, defoamers and corrosion inhibitors; and contacting said surface with a second solution consisting essentially of about 10 to 10,000 active enzyme units of at least one enzyme selected from the group consisting of lipase and a mixture of lipase and catalase.

2. The method of claim 1, including employing one or more nonionic surfactants selected from the group consisting of alkyl aryl polyether alcohols, alkyl polyether alcohols, nonionic amides, nonionic esters, ethoxylated acids and oils, sorbitan esters and ethoxylated sorbitol esters, alkyl polyglucoside surfactants, ethoxylated mercaptans, ethylene oxide/propylene oxide block copolymers, ethylene oxide/propylene oxide random copolymers, linear alcohol ethylene oxide/propylene oxide, branched alcohol ethylene oxide/propylene oxide, aryl alkaryl ethylene oxide/propylene oxide, and linear alcohol ethylene oxide with a chlorine cap, amine ethoxylates, and amine oxides.

3. The method of claim 1, further including the step of employing an anionic surfactant in conjunction with the nonionic surfactant in a ratio of between about 10:1 to 1:2.

4. The method of claim 3, including employing an anionic surfactant selected from the group consisting of alkyl sulfates, alkyl ether-sulfates, alkyl sulfonates, alkylaryl sulfonates, sulfosuccinates, phosphate esters, carboxylates, saponified organic soaps, alkyl isethionates, amine ethoxy sulfates and alkyl phenolethoxy sulfates.

5. The method of claim 4, including employing a nonionic surfactant selected from the group consisting of alkyl aryl polyether alcohols having degrees of ethoxylation from 1.5 to 120, alkyl polyether alcohols having degrees of ethoxylation from 1.5 to 120, ethoxylated mercaptans having an alkyl chain length from between about 6 and 18 carbons and a degree of ethoxylation from between about 4 and 20, and ethylene oxide/propylene oxide block copolymers, linear alcohol ethylene oxide/propylene oxide, branched alcohol ethylene oxide/propylene oxide, aryl alkaryl ethylene oxide/propylene oxide, and linear alcohol ethylene oxide with a chlorine cap, ethylene oxide/propylene oxide random copolymers, including block and random copolymers having a molecular weight from between about 1000 and 25,000, a cloud point from 10 C to greater than 100 C, and amine ethoxylates having a degree of ethoxylation from 1.5 to 75 and alkyl groups having from between about 4 to 22 carbons, and an anionic surfactant selected from the group consisting of a phosphate ester surfactant and a carboxylate surfactant in a ratio of nonionic to anionic surfactant of between about 4:1 and 1:1.

6. The method of claim 5, including employing a contact time between said surface and said first solution of at least 30 seconds and a contact time between said surface and said second solution of at least 30 seconds.

* * * * *

UNITED STATES PATENT AND TRADEMARK OFFICE

CERTIFICATE OF CORRECTION

PATENT NO. : 6,080,244
DATED : June 27, 2000
INVENTOR(S) : Christopher L. Wiatr et al.

It is certified that error appears in the above-identified patent and that said Letters Patent is hereby corrected as shown below:

Column 4,
Line 65, "inonolaurate" should read -- monolaurate --.

Signed and Sealed this

First Day of January, 2002

*Attest:*

*Attesting Officer*

JAMES E. ROGAN
*Director of the United States Patent and Trademark Office*